United States Patent [19]

Benko

[11] Patent Number: 4,572,328

[45] Date of Patent: Feb. 25, 1986

[54] SAFETY PLATFORM

[76] Inventor: John C. Benko, 6226 Oakwood Cir., North Ridgeville, Ohio 44039

[21] Appl. No.: 711,733

[22] Filed: Mar. 14, 1985

[51] Int. Cl.[4] ..... E04G 1/18; E04G 1/26

[52] U.S. Cl. ..... 182/1; 182/113; 182/141

[58] Field of Search ..... 182/113, 1, 63, 141, 182/148, 115

[56] References Cited

U.S. PATENT DOCUMENTS

| | | | |
|---|---|---|---|
| 2,326,052 | 8/1943 | Moore | 182/113 |
| 2,466,155 | 4/1949 | Conrad | 182/113 |
| 2,726,123 | 12/1955 | Mathews | 182/113 |
| 2,732,118 | 1/1956 | Reinhardt | 182/113 |
| 3,749,201 | 7/1973 | Clarke | 182/63 |
| 4,013,140 | 3/1977 | Pradon | 182/1 |
| 4,168,764 | 9/1979 | Walters | 182/1 |

*Primary Examiner*—Reinaldo P. Machado
*Attorney, Agent, or Firm*—Renner, Otto, Boisselle & Lyon

[57] ABSTRACT

This invention relates to a platform and more particularly to a vertically adjustable safety platform assembly for obtaining safety railing enclosed access to the tops of mobile equipment of various heights such as tank trucks and railroad tank and hopper cars. The assembly includes an elevated platform portion for obtaining access to the tops of mobile equipment, and a ladder for obtaining access to the platform. The platform is mounted on a column on guide rails, such platform being power driven by controls either from below or from the platform. The platform includes safety railings along the perimeter of the platform which extend beyond the perimeter so that when the platform is positioned on top of the mobile equipment a safety railing enclosure is provided.

17 Claims, 7 Drawing Figures

SAFETY PLATFORM

DISCLOSURE

This invention relates to a safety platform, and more specifically to a vertically adjustable platform assembly for obtaining safety railing enclosed access to the tops of mobile equipment of various heights such as tank trucks and railroad tank and hopper cars.

BACKGROUND OF THE INVENTION

For many years various governmental agencies such as the Occupational Safety and Health Administration have been actively promulgating regulations designed to create a healthier and safer environment for the industrial worker. In particular, regulations have focused upon the methods and equipment used in the loading and servicing of mobile equipment such as tank trucks and railroad tank and hopper cars. The present invention, in an attempt to conform with the requirements of these regulations, provides an improved safety platform for accessing the tops of various types of mobile equipment.

SUMMARY OF INVENTION

In the present invention an improved vertically adjustable safety platform assembly is provided for obtaining safety railing enclosed access to the tops of mobile equipment of various heights such as tank trucks and railroad tank and hopper cars. The assembly includes an elevated platform for obtaining access to the tops of mobile equipment, and a ladder for obtaining access to the platform. The platform is mounted on a mast on guide rails, such platform being driven by controls either from below or from the platform. The platform includes safety railings along the perimeter of the platform which extend beyond the perimeter so that when the platform is positioned on top of the mobile equipment a safety railing platform is provided which includes the platform and the portion of the top of the mobile equipment enclosed by the extending railing.

Basically, the assembly is operated by first moving the platform to the topmost position along the mast thereby providing maximum clearance for the mobile equipment that is to be serviced. After determining that sufficient clearance exists, the mobile equipment is then maneuvered beneath the platform and the platform is then lowered until it lightly touches the top of the mobile equipment providing an enclosed access. Finally, prior to moving the piece of mobile equipment, the elevated platform must once again be raised to the topmost position.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
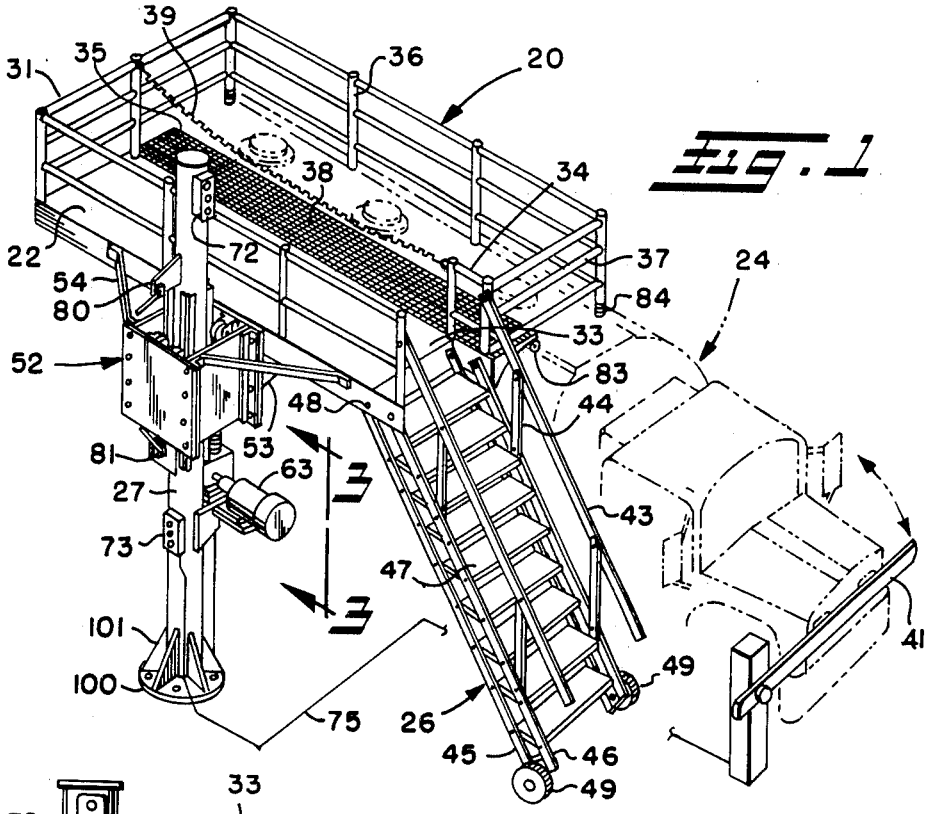
FIG. 1 is an isometric view of one preferred embodiment of the invention.

Referring in detail to the drawings and initially to FIG. 1, a vertically adjustably positionable platform assembly 20 made in accordance with the present invention is shown. The assembly comprises a platform 22 for obtaining access to the tops of mobile equipment such as a tank truck 24. Access to the platform 22 is obtained by a vertical access ladder assembly 26. The platform is supported on a vertically extending column or mast 27 for vertical movement relative to the top of the truck 24.

The platform 22 includes safety railings 31 which extend around the perimeter of the platform except at the access gateway 33 at the top of the ladder assembly which includes a relatively short inturned railing 34. The railing 31 extends beyond the projecting edge 35 of the platform 22 to extend over the top of vehicle 24. Thus when the platform is lowered on top of the vehicle, the platform cooperates with the top of the vehicle to form a railing enclosed safety platform. The railing 31 includes a number of vertical post 36 and horizontal rails 37 which support the railing extending in cantilever fashion from the platform 22, such platform extending in cantilever fashion from the column 27.

As seen in FIG. 1 a portion of the floor of the platform 22 may include an open fiberglass grating 38 to prevent the accumulation of materials such as gas, oil, grain, or the like, which may be loaded into the truck or other mobile equipment. A safety chain 39 may extend from the relatively short railing 34 to the opposite side of the railing so that access to the open portion of the enclosing railing is not permitted when the platform is elevated or the vehicle is not presented. The safety chain may readily be removed. Also, a safety gate 41 may be installed in front of the vehicle 24 for preventing inadvertent movement of the vehicle while the platform is lowered. In situations where flammable materials may be handled upon the platform, all or a portion of the platform may be constructed of non-sparking material such as fiberglass or other astatic materials. Additionally, if weather conditions present a hazard, the platform may be equipped with a protective overhead covering.

The access ladder 26 in the preferred embodiment as seen in FIG. 1 comprises handrails 43 hinged to the railing 31 at the upper end and to at least two posts 44 which are also hinged to the upper of two tread rails 45 and 46. The stair treads of the ladder indicated at 47 are hinged between such rails which are also hinged to the platform as indicated at 48, such hinges being horizontally aligned. The lower end of the ladder is supported on wheels 49 and in this manner the treads are maintained horizontal regardless of the height of the platform.

The platform 22 is cantilevered from a rectangular housing 52 through which the column or mast extends.

The platform may be supported on gussets 53 extending from such housing. Lateral braces indicated at 54 may also be provided assuring a rigid structure.

As seen more clearly in FIGS. 3, 4, 5 and 7, the housing includes a bottom transverse plate 56 on the forward side of the mast or column to which is secured flange 57 of self-locking screw 58. The screw is in mesh with a worm driven nut 60 suitably mounted between two thrust bearings in housing 61 driven for rotation by worm 62. The worm is on the drive shaft of reversible motor 63. The motor drive unit and nut assembly is mounted on shelves 65 and 66 supported from the column from the column or mast 27. As indicated more clearly in FIGS. 3 and 4, the portion of the screw 58 projecting above the nut housing is enclosed with a protective boot 68. The portion of the screw below such housing may be enclosed in a protective tube 69.

The reversible motor may be controlled from two control boxes seen at 72 and 73, the former being mounted at the top of the column 27 while the latter is mounted at ground level. In this manner access to such controls may be readily obtained either from the platform or from the ground. As illustrated in FIG. 1, the safety gate 41 may be connected to the control system through lead 75 so that the safety gate may be elevated or removed from the path of the vehicle only when the platform is in its maximum elevated position.

Figure 2:
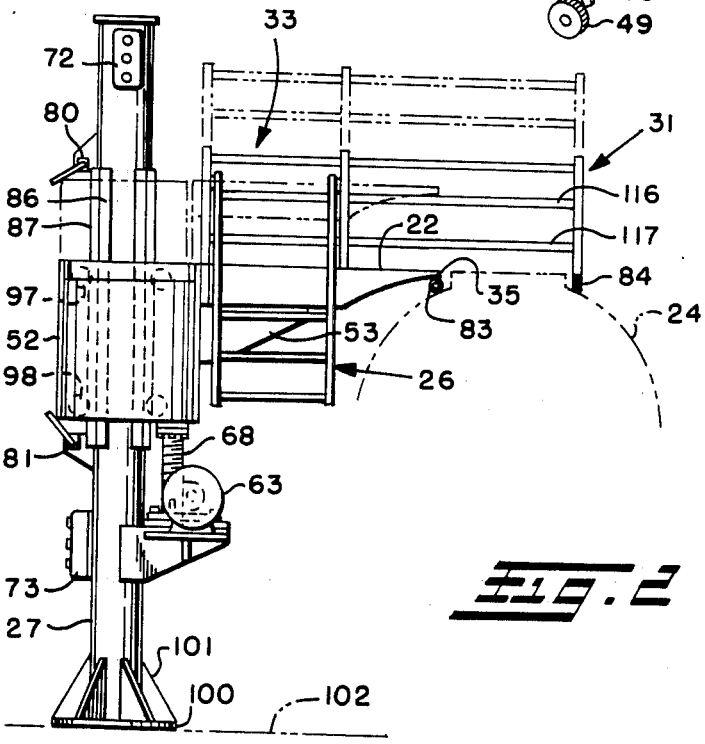
FIG. 2 is an edge elevation of the platform assembly of FIG. 1.
Figure 3:
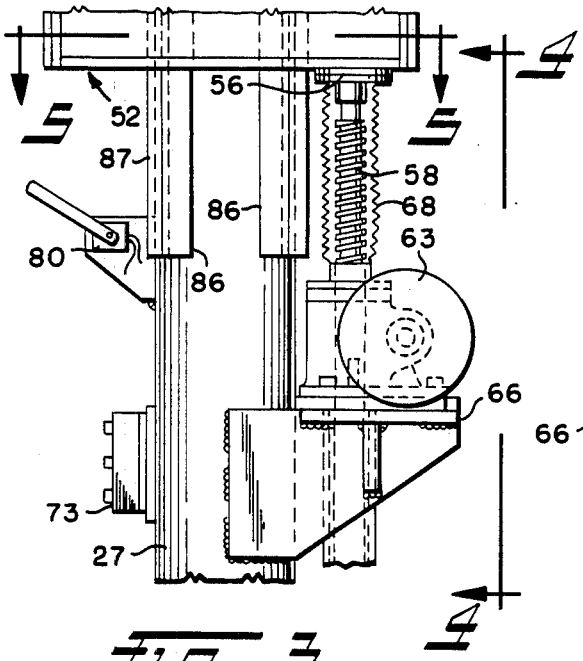
FIG. 3 is a partial edge elevational view of FIG. 1 taken along the line 3—3 thereof.
Figure 4:
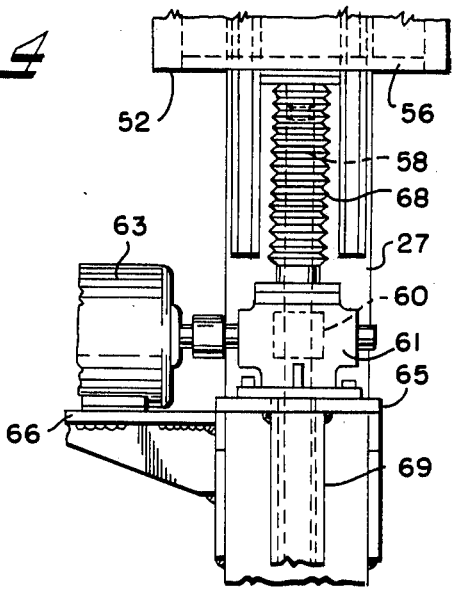
FIG. 4 is a side elevational view of FIG. 3 taken along the line 4—4 thereof.

In addition to the interlock with the gate 41, vertical limit switches may be provided as seen at 80 and 81 in FIGS. 1 and 2 to limit the vertical travel of the platform. Also, the underside of the projecting edge of the platform may be provided with a pressure switch 83 which stops downward movement of the platform when contact is made with the vehicle. The posts on the outboard side of the railing may be provided with suitable bumpers 84.

Figure 5:
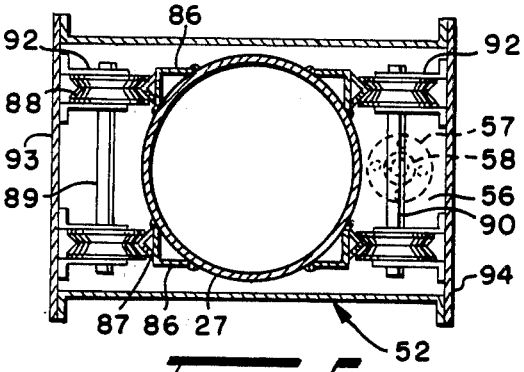
FIG. 5 is a transverse sectional view of FIG. 3 taken along the line 5—5 thereof.
Figure 7:
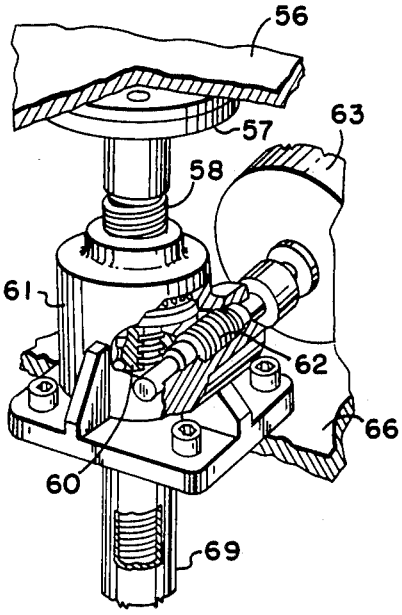
FIG. 7 is a fragmentary view of the mechanical screw actuator of FIG. 1.

Referring now more particularly to FIG. 5 it will be seen that the column or mast 27 may have welded thereto angles 86 which are equally circumferentially spaced. Secured to the fore and aft faces of such angles are V-shape rails 87 which engage V-shape groove rollers 88. The rollers are paired on each side of the column 27 and are mounted on axles seen at 89 and 90. The axles are journaled in suitable brackets 92 which are mounted on the interior of walls 93 and 94 of the housing 52.

As seen more clearly in FIG. 2, on each side of the column 27 there are two substantially vertically spaced pairs of such V-shaped rollers as indicated at 97 and 98.

The foot of the column 27 is provided with a base plate 100 interconnected by gussets 101 with the column and through such base plate the column may readily be secured as by bolting to a concrete footer or pad 102, for example.

Figure 6:
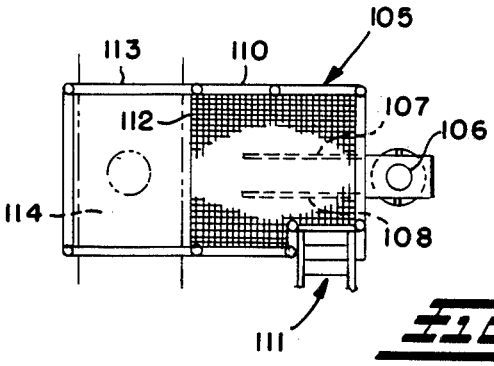
FIG. 6 is a top plan view of the invention showing a different size platform.

In FIG. 6 there is illustrated a safety platform 105 of somewhat different configuration than that illustrated in FIG. 1. The platform is mounted on the column 106 for vertical movement in the same manner as in FIG. 5 and is supported from the column in cantilever fashion by gussets or braces 107 and 108. The platform floor may be formed of grating and includes the safety railing 110 which extends around the periphery of the platform floor except for the stair access 111 and which projects beyond the outer edge of the floor 112 as indicated at 113. In the lowered position of the platform the railing encloses not only the grating platform but also a portion of the top 114 of the vehicle to provide a safety railing enclosure for working on top of the vehicle. It will thus be appreciated that the configuration of the platform may vary widely. For example, the platform may be of substantial length and have stairs or ladders at both ends and may be supported on more than one column. Also, if weather is a problem additional enclosures such as roofs may be supported from the tops of the columns. Also, loading equipment and the like may be supported on the tops of the columns.

As seen in FIG. 2, it will also be appreciated that the configuration of the cantilevered portion of the railing may be altered or varied such as by omitting the lower two horizontal rails seen at 116 and 117 in order to clear or cooperate with superstructure oten found on top of the vehicle.

With the illustrated embodiment utilizing the self-locking screw, the platform may be raised or lowered conveniently approximately 36 inches without the need for braking. Moreover, the actuator drive is a selfcontained unit which may readily be serviced or replaced.

In operation the safety platform of the present invention is normally initially in its up position. After the tank truck 24 is properly positioned, the operator either from on the platform or below the platform may then lower the platform. The pressure sensitive switch 83 will cause the platform to stop in the proper position after contact with the top of the vehicle is made. The operator then simply climbs the stairs 26, removes the safety chain 39 and is then provided with a safety railing enclosed platform for working on top of the vehicle. After whatever work is completed, the platform is then again elevated and the uppermost position of the platform may elevate the safety gate 41 permitting the truck to be pulled away. The rigid platform and the accessible controls which include "up", "down" and "stop" buttons together with the self-locking screw provide a safety platform affording convenient and safe access to the tops of vehicles such as tank trucks, tank cars and hopper cars.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. A vertically movable safety platform for providing a safety railing enclosed work area on top of mobile equipment such as tank trucks and the like comprising a vertically extending mast, a platform cantilevered from said mast, and power means for vertically moving said platform along said mast, said platform including a safety railing which extends beyond one edge of said platform so that when said platform is lowered on top of said mobile equipment said safety railing encloses said platform and a portion of the top of said mobile equipment to provide such safety railing enclosed work area.

2. A platform as set forth in claim 1 wherein said power means comprises a screw fixed to said platform, and a power driven nut in mesh with said screw mounted on said mast.

3. A platform as set forth in claim 2 wherein said screw is mounted on said platform on the same side of said mast from which said platform is cantilevered.

4. A platform as set forth in claim 3 wherein said screw and nut are self-locking.

5. A platform as set forth in claim 4 wherein said nut is driven by a reversible motor.

6. A platform as set forth in claim 5 including control means for said motor accessible from both the platform and the base of the mast.

7. A platform as set forth in claim 6 including switch means operative to stop said motor upon engagement of said switch means with the top of said mobile equipment.

8. A platform as set forth in claim 1 including ladder means providing access to said platform.

9. A platform as set forth in claim 8 wherein said ladder means comprises stairs which include treads hinged to stair rails in turn hinged to said platform to provide a parallelogram linkage operaive to maintain said treads parallel to said platform at all vertical positions thereof.

10. A platform as set forth in claim 9 wherein said stairs include hand rails also hinged to said platform and to one of said stair rails to maintain said hand rails parallel to said stairs at all vertical positions of said platform.

11. A platform as set forth in claim 10 including wheels at the lower end of said stairs.

12. A platform as set forth in claim 1 wherein said platform includes a vertically open housing surrounding said mast, rails on said mast, and rollers on said housing engaging said rails and mounting said platform on said mast for such vertical movement.

13. A platform as set forth in claim 12 wherein said mast is circular and said housing is rectangular in horizontal section.

14. A platform as set forth in claim 13 wherein said rails are V-shape and are mounted on angles to said mast, there being two such rails on each side of said mast in the directon of cantilever of said platform.

15. A platform as set forth in claim 14 including paired vertically spaced V-shape rollers journaled in said housing riding on said rails.

16. A platform as set forth in claim 1 including a safety gate operative to prevent movement of said mobile equipment when said platform is in its lowered position.

17. A platform as set forth in claim 1 wherein said safety railing as it extends beyond said platform is configured to clear superstructure on said mobile equipment.

* * * * *